United States Patent [19]

Suzuki et al.

[11] Patent Number: 4,722,195

[45] Date of Patent: Feb. 2, 1988

[54] HEAT PUMP WITH A RESERVOIR STORING HIGHER PRESSURE REFRIGERANT OF NON-AZEOTROPIC MIXTURE

[75] Inventors: Shigeo Suzuki, Osaka; Yuji Yoshida, Itami; Kazuo Nakatani; Yuji Mukai, both of Osaka, Japan

[73] Assignee: Matsushita Electric Industrial Co., Ltd., Japan

[21] Appl. No.: 844,065

[22] Filed: Mar. 25, 1986

[30] Foreign Application Priority Data

| | | | |
|---|---|---|---|
| Mar. 25, 1985 | [JP] | Japan | 60-59908 |
| Apr. 12, 1985 | [JP] | Japan | 60-77639 |
| Aug. 29, 1985 | [JP] | Japan | 60-190793 |
| Aug. 29, 1985 | [JP] | Japan | 60-190794 |
| Aug. 29, 1985 | [JP] | Japan | 60-190797 |

[51] Int. Cl.[4] ..... F25B 45/00

[52] U.S. Cl. ..... 62/149; 62/174; 62/324.1; 62/502

[58] Field of Search ..... 62/149, 174, 324.5, 62/324.1, 0.4, 117, 502

[56] References Cited

U.S. PATENT DOCUMENTS

| | | | |
|---|---|---|---|
| 2,938,362 | 5/1960 | Schwind | 62/149 |
| 3,637,005 | 1/1972 | Nussbaum | 62/174 X |
| 4,416,119 | 11/1983 | Wilson et al. | 62/174 X |

*Primary Examiner*—Lloyd L. King

*Attorney, Agent, or Firm*—Lowe, Price, LeBlanc Becker & Shur

[57] ABSTRACT

Disclosed is a heat pump comprising a main circuit containing a mixture of non-azeotropic refrigerants, the main circuit including a compressor for pressurizing the mixture, a first heat exchanger operating as a heat sink, a second heat exchanger operating as a heat source, and an expansion device connected between the first and second heat exchangers. A portion of the mixture is supplied through a first feed line from a first junction between the expansion valve and the first heat exchanger and vaporized before being fed to a rectifier where it coacts with liquid refrigerant to cause separation of higher pressure refrigerant of the mixture from the lower pressure refrigerant. The separated higher pressure refrigerant is stored in a reservoir in liquid phase and an overflowed portion of the liquid is returned to the rectifier as said coacting liquid. A second feed line couples a second junction between the expansion device and the second heat exchanger to a bottom portion of the rectifier to complete an auxiliary circuit. A bypass line is established from the bottom portion of reservoir to the second junction accordance with input power demand to control the operation of the rectifier.

18 Claims, 10 Drawing Figures

HEAT PUMP WITH A RESERVOIR STORING HIGHER PRESSURE REFRIGERANT OF NON-AZEOTROPIC MIXTURE

BACKGROUND OF THE INVENTION

The present invention relates to a heat pump apparatus using a mixture of non-azeotropic refrigerants.

One prior art heat pump apparatus, which is known as an "inverter" system, is shown in FIG. 1 which comprises a compressor 40, a four-way valve 41, a heat exchanger 42 acting as a heat sink, an expansion device 43 and a heat exchanger 44 acting as a heat source, all of which are connected in a series circuit. The compressor is driven by a motor 45 which is controlled by a frequency converter 46 which converts the frequency of the mains supply 47 in response to manual commands. The rotational speed of the motor is controlled by varying the frequency of the current supplied from the frequency converter 46 in accordance with power demand. However, since the working fluid is of a single composition refrigerant, such as the type R22, and since the thermal transfer area of the heat exchangers 42 and 44 are constant, an increase in frequency causes the condensation temperature of the system to increase and the evaporation temperature to decrease. As illustrated in FIG. 2, when the operating frequency is low, the pressure-enthalpy cycle of the system follows a solid-line curve. However, when the frequency is high, the higher pressure of the system (condensation temperature) rises while the lower pressure (evaportion temperature) drops, resulting in a cycle indicated by a broken-line curve. Of primary concern is the shift from line a–b to line a′–b′ (which represents the compression stroke of compressor 40) coupled with the increase in the condensation temperature results in a sharp increase at the outlet of the compressor, which could lead to the decomposition of the refrigerant and deterioration of thermal insulation. These factors present a significant increase in the load of frequency converter 46 at high frequency operation. In addition, refrigeration power output does not increase proportionally to the increase in frequency since the lower pressure drop causes the specific volume of the compressor's intake stroke to increase.

For the reasons given above, the upper limit of the variable frequency must be determined from the system's reliability point of view or determined by the maximum power delivered during startup period.

Another prior art heat pump apparatus, as disclosed in U.S. Pat. No. 2,938,362, comprises a rectifier in the main circuit of the apparatus and employs a mixture of non-azeotropic refrigerants. The rectifier controls the mixture ratio of the refrigerants so that the amount of the fluid circulating the main circuit is varied to meet desired power demand. The rectifier separates the mixture and stores the lower pressure refrigerant in a reservoir and circulates a fluid with a high content the higher pressure refrigerant through the main circuit during operation. A three-way valve is used to route the lower pressure refrigerant in the reservoir to be mixed with the fluid in the main circuit during standby periods to restore the mixture to the original ratio. However, the enrichment of the main circuit fluid is a process too slow to meet a sharp rise in power demand.

Our experiments show that for a given combination of higher and lower pressure refrigerants the amount of optimum working fluid in the main circuit increases with the content of the higher pressure refrigerant. Specifically, using refrigenrants R12 and R13B1 as low and high pressure refrigerants, respectively, zero content of R13B1 in the working fluid requires a total of 800 grams of refrigerant R12 for optimum condition, 50% content of R13B1 requires 950 grams of the mixture and 80% content results in the requirement of 1200 grams of the mixture. This is considered to arise from the fact that with increase in higher pressure refrigerant, the specific volume of the refrigerant gas decreases, causing the optimum volume of the working fluid in the refrigeration circuit to increase undesirably from the compressor's performance point of view. Furthermore, a substantial amount of refrigerant mixture must be stored during standby periods. In addition, an electric heater is required to heat the rectifier, increasing the total amount of energy. Since the rectifier is connected in a lower-pressure circuit, the working fluid empties the rectifier and enters the main circuit during cooling operation. As a result, the rectifier is inoperative during cooling operation and the amounts of working fluid required for both cooling and heating operations largely deviate from each other and thus it is impossible to operate the apparatus with an optimum amount of refrigerant.

SUMMARY OF THE INVENTION

It is an object of the present invention to provide a heat pump apparatus in which a mixture of non-azeotropic refrigerants is circulated in a main circuit and the higher pressure refrigerant of the mixture is separated from the lower pressure refrigerant by a rectifier and stored in a reservoir to permit a mixture having a higher content of the lower pressure refrigerant to recirculate the main circuit during low power mode and permit a mixture with an intrinsic ratio of higher-to-lower pressure refrigerants to recirculate the circuit during high power mode.

A heat pump apparatus of the invention comprises a main circuit containing a mixture of non-azeotropic refrigerants, the main circuit including a compressor for pressurizing the mixture, a first heat exchanger operating as a heat sink, a second heat exchanger operating as a heat source, and an expansion device connected between the first and second heat exchangers. A portion of the mixture flows through a first feed line from a junction between the expansion device and the first heat exchanger and is vaporized and fed to a rectifier where it coacts with liquid refrigerant to cause separation of higher pressure refrigerant of the mixture from the lower pressure refrigerant. A reservoir stores the separated higher pressure refrigerant in liquid phase and feeds an overflowed portion of the stored refrigerant back to the rectifier as said coacting liquid. A second feed line couples a junction between the expansion device and the second heat exchanger to a bottom portion of the rectifier to complete an auxiliary circuit. Further included is a means for disabling and enabling the rectifier in accordance with input power demand.

The storage of higher pressure refrigerant in the reservoir allows the reduction of power output to a level lower than the prior art apparatus, increasing the operating range commensurate with the range of variation of frequency to which the compressor power is proportional, and further allows a quick delivery of high power output by a mixture rich with the higher pressure refrigerant during startup of the apparatus. Furthermore, the invention permits a smaller amount of refrigerants than is required with the aforesaid U.S. patent in which the lower pressure refrigerant is stored.

BRIEF DESCRIPTION OF THE DRAWINGS

The present invention will be described in further detail with reference to the accompanying drawings, in which.

DETAILED DESCRIPTION

Figure 1:
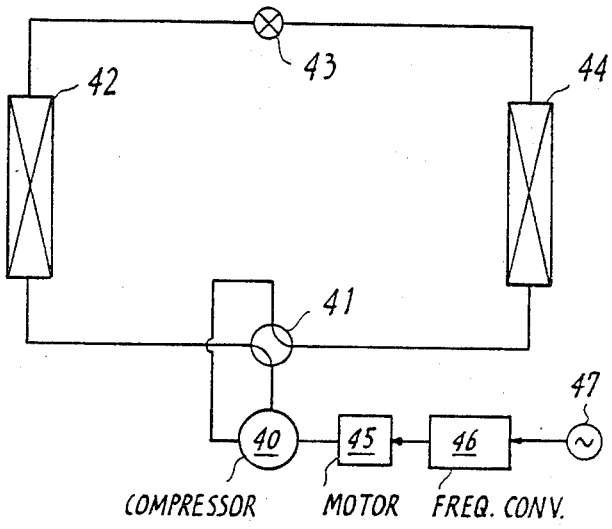
FIG. 1 PRIOR ART
FIG. 1 is an illustration of a prior art heat pump.
Figure 2:
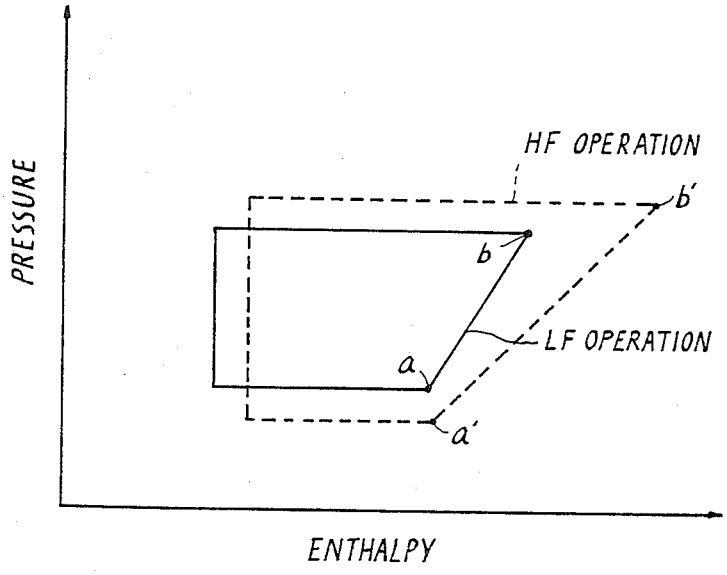
FIG. 2 PRIOR ART
FIG. 2 is a graphic illustration of the operating characteristics of the prior art heat pump.
Figure 3:
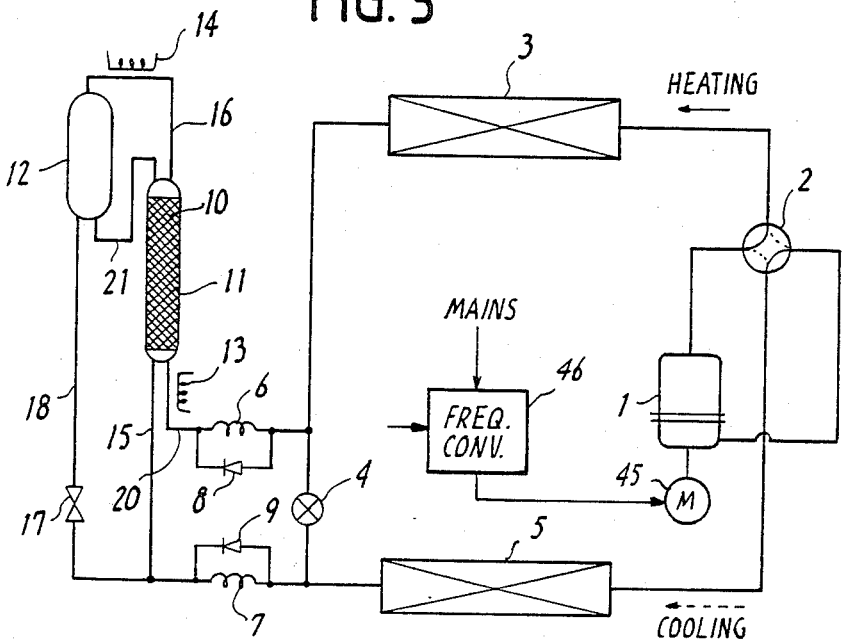
FIG. 3 is an illustration of a first embodiment of the invention in which the rectifier is disabled by a bypass circuit coupling the reservoir to the heat exchanger operating as a heat source.

Referring to FIG. 3, a heat pump apparatus according to the present invention is shown. The apparatus comprises a main refrigeration circuit including a compressor 1, a four-way valve 2, a heat exchanger 3 operating as a heat sink, an expansion valve 4 and a heat exchanger 5 operating as a heat source. As in the prior art of FIG. 1, the compressor 1 is driven by motor 45 of which the speed is varied under control of frequency converter 46. Converter 46 converts the frequency of the mains supply in accordance with a desired power setting level and drives the motor at a variable speed determined by the converted frequency. Four-way valve 2 is connected so that during heating operation the working fluid under pressure is routed to the heat exchanger 3 acting as a condensor and during cooling operation the working fluid under pressure is routed to the heat exchanger 5 acting as a condenser. Expansion valve 4 is connected between heat exchangers 3 and 5 and in parallel with an auxiliary refrigeration circuit which comprises an expansion device or capillary tube 6 with a check valve 8 connected in parallel therewith, a rectifier 11 with a filling material 10 therein, a reservoir 12 located at a position higher than rectifier 11 and a capillary tube 7 with a check valve 9 connected in parallel therewith. Capillary tube 6 is connected to the bottom of rectifier 11 by a line 20 which is in heat transfer relationship with a heating device 13 which serves to vaporize fluid therein. The top of rectifier 11 is connected to reservoir 12 by a line 16 which is in heat transfer relationship with a liquiding device or cooler 14 which serves to condense the vaporized fluid. The bottom of rectifier 11 is further coupled by a line 15 to the capillary tube 7 to complete the auxiliary circuit. The auxiliary circuit is bypassed by a line 18 having an on-off solenoid valve 17, the line 18 being connected at one end to the bottom of reservoir 12 and at the other end to capillary tube 7. The main circuit is filled with a mixture of non-azeotropic refrigerants having a predetermined intrinsic ratio of higher pressure refrigerant to lower pressure refrigerant.

Heater 13 and cooler 14 are connected to the compressor 2 in a manner as will be described later to cause the vaporized fluid to flow upwards through rectifier 11 and cause fluid in reservoir 12 to flow through line 21 to rectifier 11, generating a downward flow of working liquid within rectifier 11. The oppositely moving streams of gas and liquid contact with each other with the aid of the filling material 10 to produce a fluid having a high content of higher pressure refrigerant in reservoir 12, a phenomenon known as "rectifying action".

Capillary tubes 6, 7 and check valves 8, 9 allow a portion of working fluid in the main circuit to flow into and out of the auxiliary circuit regardless of the direction of flow in the main circuit. In addition, check valves 8 and 9 serve to maintain the rectifier at a pressure equal to the outlet of the higher-pressure side heat exchanger to provide a constant amount of flow in the rectifier regardless of heating and cooling operations. Each of the capillary tubes 6 and 7 has a flow resistance greater than the flow resistance of expansion valve 4 so that the fluid circulating the auxiliary circuit may not impede the rectifying action and that heater 13 can vaporize the fluid efficiently. The flow resistance of valve 4 must be determined in relation to the compositions of working fluid employed and in relation to the temperatures at the inlet and outlet of compressor 1.

During a heating mode, the four-way valve 2 is switched to route the pressurized working fluid through the heat exchanger 3, expansion valve 4 to heat exchanger 5. Part of the fluid flows through the first portion of the auxiliary circuit that includes check valve 8, line 20, the bottom portion of rectifier 11, line 15 and capillary tube 7.

To operate the apparatus at a low-level heating power settig, solenoid valve 17 is de-energized to shut off the passage 18. Mixture in liquid phase flows through line 20 at such a flow rate that the higher pressure refrigerant of the mixture is vaporized by the heater 13, causing the vaporized higher pressure refrigerant to move upward through rectifier 11 and causing the gas to be condensed by the cooler 14. The condensed fluid flows into reservoir 12. Refrigerant liquid overflowing the reservoir returns to rectifier 11 through line 21 to cause a downward flow of working liquid, generating a rectifying action with the upward flow of working gas through the filling material 10. Thus, the content of higher pressure refrigerant liquid in reservor 12 increases as the rectification continues. As a result, working fluid rich with lower pressure refrigerant is delivered from rectifier 11 through passage 15 and capillary tube 7 to the exchanger 5 on the lower pressure side, allowing the exchanger 3 on the higher pressure side to operate at a desired low heating power level.

For high heating power operation, solenoid valve 17 is energized to open the passage 18 to cause working fluid to pass to the heat exchanger 5, so that the fluid dominantly flows through the path including check valve 8, rectifier 11, line 16, reservoir 12, line 18 and capillary tube 7. As a result, a high-speed upward flow is generated within the rectifier 11 to retard the downward flow of liquid overflowing the reservoir 12, preventing the rectifying action. Thus, heat exchanger 3 operates at full power with the non-azeotropic refrigerants having the intrinsic ratio of the refrigerants. The rectifying action can be effectively prevented by determining the flow resistance of passage 18 so that mixture in line 20 flows at a rate too high for the heater 13 to vaporize the higher pressure refrigerant of the mixture.

During cooling operation, pressurized working fluid is routed by valve 2 to the heat-source side exchanger 5. Most of the fluid leaving the exchanger 5 is passed through expansion valve 4 to the heat-sink side exchanger 3 and returns to the compressor 1 and the remainder is passed through the check valve 9 and through line 15 to the rectifier 11, passing through its lower portion to capillary tube 6 and thence to the exchanger 3, causing the same rectifying action to occur in rectifier 11 as during heating operation.

For low power cooling operation, solenoid 17 is deenergized to shut off the bypass line 18, causing a rectifying action to occur in the rectifier in a manner similar to that described above.

High power cooling operation is performed by energizing the solenoid valve 17. This causes fluid to pass through line 18 to reservoir 12 with a resultant high-speed downward flow in rectifier 11 to counteract the upward flow of working gas. Rectifying action no longer occurs and the heat-sink side exchanger 3 operates at high power with the working fluid having the intrinsic mixture ratio.

There is a constant flow of working fluid through a circuit including lines 15, 20 and the bottom of rectifier 11 and as a result there is no sudden change in the amount of working fluid in the main circuit in response to the occurrence of a transient condition such as the switching on and off of the solenoid valve 17.

Advantages of the present invention are as follows. The storage of higher pressure refrigerant in the reservoir allows the reduction of power output to a level lower than the prior art apparatus and thus increases the operating range commensuate with the operating range of frequency converter 46. Further, the invention allows a quick delivery of high power output by causing a mixture rich with the higher pressure refrigerant to be quickly made available during startup of the apparatus. Furthermore, the invention permits a smaller amount of refrigerants than is required with the aforesaid U.S. patent in which the lower pressure refrigerant is stored.

Figure 4:
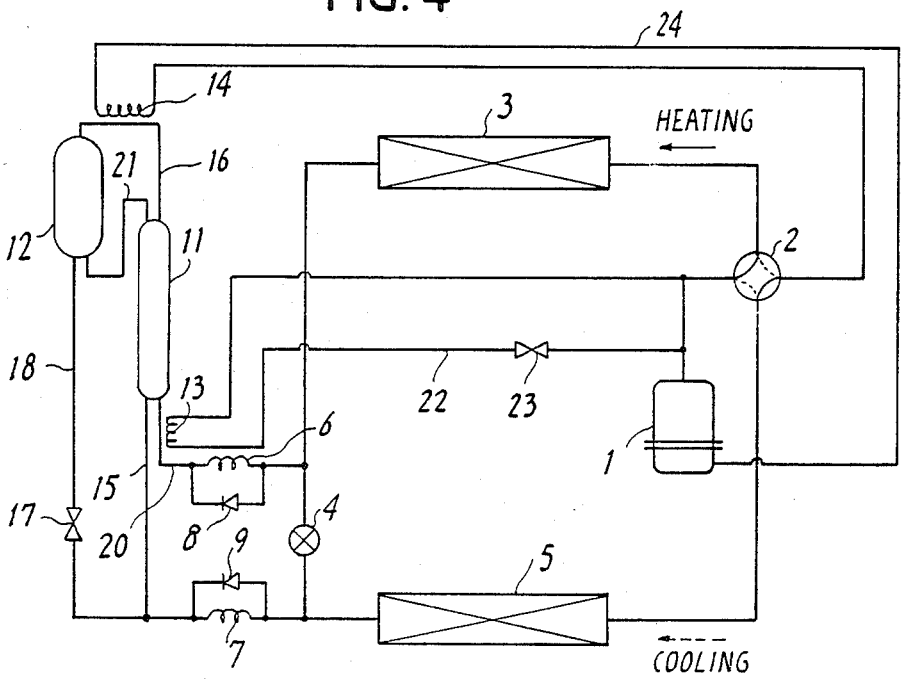
FIG. 4 is an illustration of an exemplary embodiment of the invention in which vaporizing and liquidizing devices are supplied with energies extracted from the main circuit.

Heater 13 and cooler 14 are connected in a manner as shown in FIG. 4. In this embodiment, pressurized fluid from compressor 1 is applied through a high-pressure bypass line 22 to heater 13. A solenoid valve 23 is connected in the circuit 22 to control the amount of high-pressure fluid to heater 13 to control vaporization. The return path of the high-pressure line 22 may be connected to the high-pressure side of compressor 1 or to the inlet of the evaporator. In the latter case, defrosting performance during heating operation can be improved. Cooler 14 is connected in a low-pressure line 24 in series with heat exchanger 5 to the low-pressure side of compressor 1. Similar to heater 13, cooler 14 may be coupled by a bypass line to the low-pressure side of compressor 1. Heater 13 and cooler 14 are thus constantly supplied with heating end cooling energies respectively, regardless of the direction of flow of the working fluid in the main circuit.

The operating performance of compressors depend on various factors including thermal transfer loss, pressure loss, friction loss, re-expansion loss. The dominant factor is the thermal transfer loss during intake and compression strokes. It is known that such thermal transfer loss can be reduced or minimized by cooling the cylinder or lubricating oil of the compressor.

Figure 5:
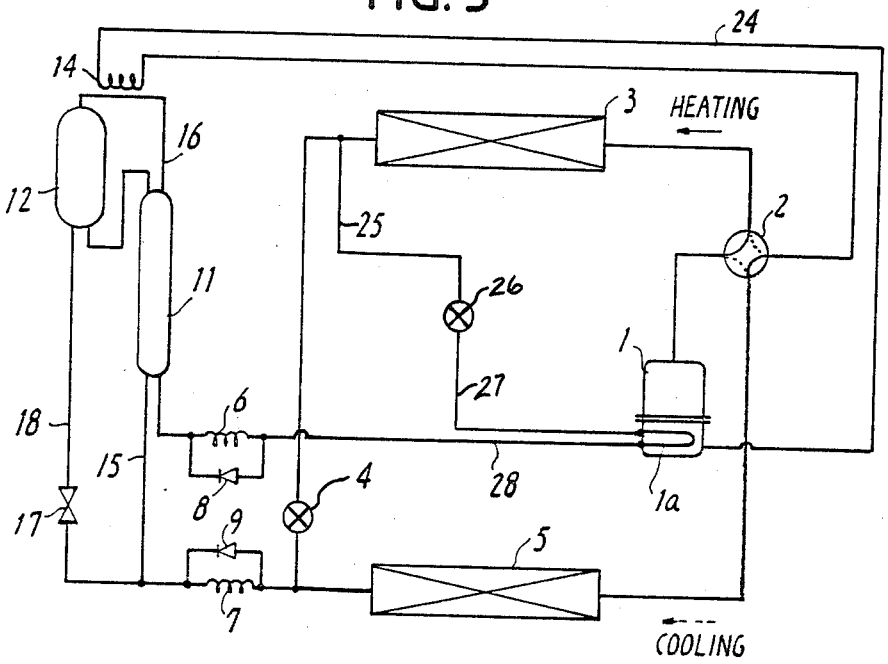
FIG. 5 is an illustration of a modification of the embodiment of FIG. 4.

To utilize this principle, the embodiment of FIG. 4 is modified as shown in FIG. 5. In this embodiment, thermal energy generated in the lubricating oil of compressor 1 is extracted by a coil 1a to increase the energy level of the working fluid emerging from the higher-pressure side heat exchanger. During a heating mode, the outlet of heat exchanger 3 is coupled by a high-pressure line 25 and a two-way valve 26 to the inlet of coil **1*a* via line 27, the outlet of which is connected by a line 28 to check valve 8. During each operating mode, the amount of working gas in rectifier 11 is increased by the energy extracted from the lubricating oil. The latter is in turn cooled off, significantly reducing the thermal transfer loss of the compressor 1**.

Figure 6:
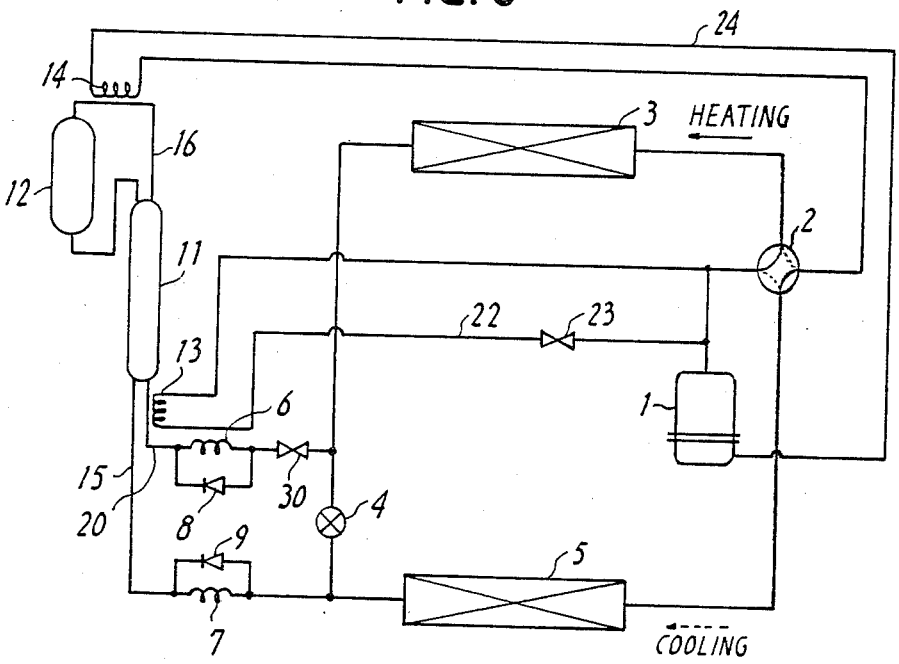
FIG. 6 is an illustration of a modification of the embodiment of FIG. 3 in which the rectifier is disabled by shutting off a line leading from the main circuit to the rectifier during high power heating operation.

FIG. 6 is an illustration of a further modification of the invention in which the heater 13 takes its energy from the high-pressure side of compressor 1 through a bypass circuit 22 and the cooler 14 takes its energy from the lower-pressure side of compressor in a manner identical to that shown in FIG. 4. In this modification, rectifying action is disabled during high power heating operation. To accomplish this, the bypass circuit 18 is removed and an on-off valve 30 is connected between the check valve 8 and the outlet of exchanger 3. With valve 30 being turn-on, working fluid under pressure from exchanger 3 passes through valves 30 and 8 to rectifier 11, so that it is vaporized during heating operation by heater 13 to effect the rectification. When high power heating is desired, valve 30 is turned off. Vapor supply to the rectifier 11 is shut off and the most of fluid under pressure is routed through expansion valve 4 to the heat-source side exchanger 5. Rectification is shut down and the main circuit operates with working fluid having the intrinsic mixture rate.

Figure 7:
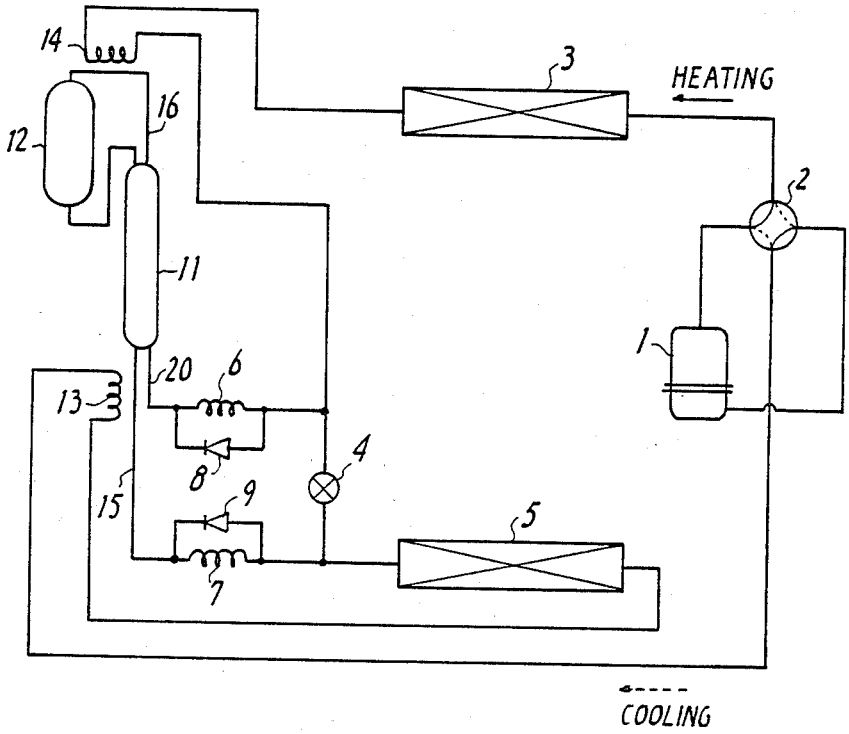
FIG. 7 is an illustration of a second embodiment of the invention in which the rectification is disabled during heating operation.

FIG. 7 is an illustration of a further modification in which the rectification is enabled only during cooling operation. During a cooling operation, fluid under pressure is routed by valve 2 to the heater 13 and thence to the inlet of heat exchanger 5. Fluid leaving the exchanger 5 is passed through valve 4 to the cooler 14 as a source of cooling energy to condense fluid passing through line 16, the fluid leaving the cooler 14 being passed through valve 4 to exchanger 3. Heater 13 is located in heat transfer relationship with circuit 15, rather than with circuit 20, to vaporize fluid delivered from the heat exchanger 5. During a heating operation, fluid under pressure is routed to exchanger 3 and applied to cooler 14 as cooling energy source. The fluid circulates through valve 4 and exchanger 5 and through heater 13 to compressor 1. This embodiment allows compact design.

Figure 8:
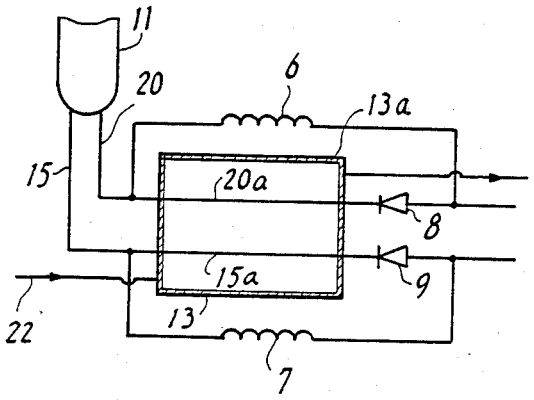
FIGS. 8 and 9 are illustrations of modified forms of vaporizing and liquidizing devices, respectively.

An embodiment shown in FIG. 8 is advantageous for reducing the size of the heater 13. Heater 13 comprises a housing **13*a* to which high-pressure energy is supplied through circuit 22 from compressor 1 and in which are disposed circuits 20*a* and 15*a* which lead from check valves 8 and 9 to circuits 20 and 15, respectively, so that heater 13 is in heat transfer relationship with both of the circuits 20*a* and 15*a*. During heating modes, working fluid passes through check valve 8 and circuits 20*a*, 20 to rectifier 11 and it returns through circuit 15 and capillary tube 7, and during cooling modes the fluid passes through check valve 9 and circuits 15***a*, 15 to rectifier 11 and returns through circuit 20 and check valve 6.

Figure 9:
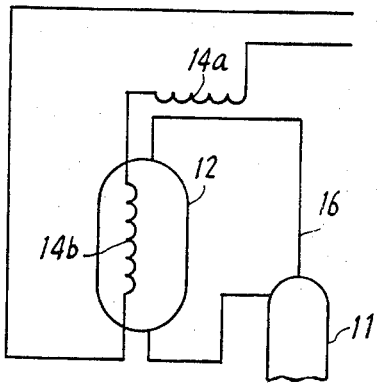

FIG. 9 is an illustration of a modified form of the liquidizing device 14 which allows compact design. In this modification, cooler 14 is divided into a first portion 14*a* and a second portion 14*b*. First portion 14*a* is in heat transfer relationship with circuit 16 and second portion 14*b* is accommodated in reservoir 12.

Figure 10:
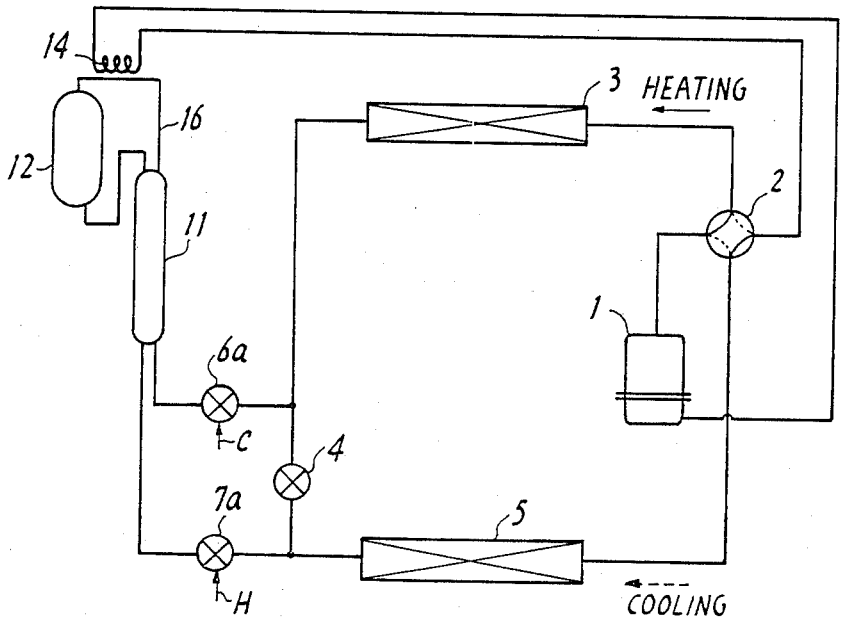
FIG. 10 is an illustration of a third embodiment of the invention in which the vaporizing devices is replaced with expansion devices having variable flow resistances.

In the previous embodiments, the pressure inside rectifier 11 is maintained at the same level as the higher pressure of the main circuit by a low-resistance coupling with the use of check valves 8 and 9. FIG. 10 is an illustration of a further embodiment of the present invention in which the check valves 8 and 9 are dispensed with and capillary tubes 6 and 7 are replaced with solenoid-operated expansion valves 6*a* and 7*a*, respectively. Expansion valves 7*a* and 6*a* are respectively controlled by heating and cooling power control signals H and C. In the absence of these signals, each of expansion valves 6*a* and 7*a* has a flow resistance greater than the flow resistance of expansion valve 4 to provide pressure reduction in the passage 20 during heating modes and pressure reduction in the passage 15 during cooling modes, so that the pressure inside the rectifier reduces to a level at which the working fluid spontaneously vaporizes. This allows the rectifier to perform rectifying action during both heating and cooling modes without the need for extracting energy from external sources, allowing the heater 13 to be dispensed with. Power control is effected by disabling the rectifying action by application of each of the signals H and C to the associated expansion valve. By the application of these signals, the flow resistance of each expansion valve reduces to a level lower than the flow resistance of expansion valve 4. Thus, the application of signal H to valve 7*a* causes it to increase the amount of working fluid passing through the passage 15 so that the latter serves as a bypass circuit to switch the fluid to pass through passage 20, the bottom of rectifier 11 and valve 7*a* to exchanger 5, thus inhibiting the rectifying action. Likewise, the application of signal C to valve 6*a* during a cooling mode causes the passage 20 to act as a bypass circuit for switching the fluid to flow through passage 15, the bottom of rectifier 11 and valve 6*a* to the exchanger 3, causing the rectifying action to cease.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A heat pump apparatus comprising:

a main circuit containing a mixture of non-azeotropic refrigerants, the main circuit including a compressor for pressurizing the mixture, a first heat exchanger operating as a heat sink, a second heat exchanger operating as a heat source, and an expansion device connected between said first and second heat exchangers;

means for vaporizing a portion of the mixture from said main circuit;

a rectifier for rectifying the vaporized mixture and separating higher pressure refrigerant of the mixture from lower pressure refrigerant of the mixture;

a reservoir for storing the separated higher pressure refrigerant in liquid phase and feeding an overflowed portion of the stored refrigerant back to said rectifier to cause same to effect the separation;

a first feed line coupling a junction between said expansion device and said first heat exchanger to a bottom portion of said rectifier;

a second feed line coupling a junction between said expansion device and said second heat exchanger to a bottom portion of said rectifier, one of said first and second feed lines being associated with said vaporizing means in phase conversion relationship; and means for disabling and enabling said rectifier in accordance with power demand.

2. A heat pump apparatus as claimed in claim 1, wherein said vaporizing means comprises an expansion device connected in one of said first and second feed lines.

3. A heat pump apparatus as claimed in claim 1, wherein said vaporizing means comprises a heating device in energy transfer relationship with one of said first and second feed lines.

4. A heat pump apparatus as claimed in claim 1, further comprising liquidizing means for converting the higher pressure refrigerant of the mixture in vapor phase separated by said rectifier into liquid phase.

5. A heat pump apparatus as claimed in claim 4, wherein said liquidizing means is supplied with a portion of the mixture from said main circuit.

6. A heat pump apparatus as claimed in claim 5, further comprising means for routing the pressurized mixture to said first heat exchanger during a heating mode and routing the pressurized mixture to said second heat exchanger during a cooling mode, wherein said liquidizing means is connected between said expansion device and said first heat exchanger.

7. A heat pump apparatus as claimed in claim 1, wherein said vaporizing means includes means for extracting energy from a portion of said main circuit and vaporizing said portion of the mixture from said main circuit with the extracted energy.

8. A heat pump apparatus as claimed in claim 1, further comprising means for routing the pressurized mixture to said first heat exchanger during a heating mode and routing the pressurized mixture to said second heat exchanger during a cooling mode, wherein each of said first and second feed lines includes an expansion device and a check valve connected in parallel therewith, said check valve passing the mixture from said main circuit to said rectifier therethrough.

9. A heat pump apparatus as claimed in claim 1, wherein one of said first and second feed lines includes an expansion device having a flow resistance greater than the flow resistance of the expansion device of the main circuit.

10. A heat pump apparatus as claimed in claim 1, further comprising a first expansion device in said first feed line and a second expansion device in said second feed line, each of said first and second expansion devices having a variable flow resistance ranging from a value lower than the flow resistance of the expansion device of said main circuit to a value higher than the last-mentioned flow resistance.

11. A heat pump apparatus as claimed in claim 1, wherein said vaporizing means includes means for extracting energy from lubricating oil of said compressor and transferring the extracted energy to said portion of the mixture from said main circuit.

12. A heat pump apparatus as claimed in claim 1, wherein said vaporizing means comprises a heating device, means for supplying energy to said heating device from said main circuit and means for controlling the amount of said supplied energy.

13. A heat pump apparatus as claimed in claim 1, further comprising an on-off valve connected in one of said first and second feed lines.

14. A heat pump apparatus as claimed in claim 1, wherein said disabling and enabling means comprises a third feed line connecting a junction between said expansion device and said second heat exchanger to said reservoir and an on-off valve connected in said third feed line.

15. A heat pump apparatus as claimed in claim 1, further comprising a frequency converter adapted for connection to a mains supply for converting the frequency of the mains supply in accordance with a desired power setting, and a motor for driving said compressor at a speed as a function of the frequency converted by said frequency converter.

16. A heat pump apparatus comprising:

a main circuit containing a mixture of non-azeotropic refrigerants, the main circuit including a compressor for pressurizing the mixture, a first heat exchanger operating as a heat sink, a second heat exchanger operating as a heat source, an expansion device connected between said first and second heat exchangers, and means for routing the pressurized mixture to said first heat exchanger during a heating mode and routing the pressurized mixture to said second heat exchanger during a cooling mode;

means for vaporizing a portion of the mixture from said main circuit;

a rectifier for rectifying the vaporized mixture and separating higher pressure refrigerant of the mixture from lower pressure refrigerant of the mixture;

a reservoir for storing the separated higher pressure refrigerant in liquid phase and feeding an overflowed portion of the stored refrigerant back to said rectifier to cause same to effect the separation;

a first feed line coupling a junction between said expansion device and said first heat exchanger to said rectifier;

a second feed line coupling a junction between said expansion device and said second heat exchanger to a bottom portion of said rectifier, one of said first and second feed lines being associated with said vaporizing means in phase conversion relationship; and means for disabling said rectifier during said heating mode and enabling said rectifier during said cooling mode.

17. A heat pump apparatus as claimed in claim 16, wherein said vaporizing means comprises an expansion device connected in one of said first and second feed lines.

18. A heat pump apparatus comprising:

a main circuit containing a mixture of non-azeotropic refrigerants, the main circuit including a compressor for pressurizing the mixture, a first heat exchanger operating as a heat sink, a second heat exchanger operating as a heat source, and an expansion device connected between said first and second heat exchangers;

means for vaporizing a portion of the mixture from said main circuit;

a rectifier for rectifying the vaporized mixture and separating higher pressure refrigerant of the mixture from lower pressure refrigerant of the mixture;

a reservoir for storing the separated higher pressure refrigerant in liquid phase and feeding an overflowed portion of the stored refrigerant back to said rectifier to cause same to effect the separation;

a first feed line coupling a junction between said expansion device and said first heat exchanger to a bottom portion of said rectifier;

a second feed line coupling a junction between said expansion device and said second heat exchanger to a bottom portion of said rectifier, one of said first and second feed lines being associated with said vaporizing means in phase conversion relationship; and a third feed line connecting a junction between said expansion device and said second heat exchanger to said reservoir; and an on-off valve connected in said third feed line.

* * * * *